US007845521B2

(12) United States Patent
Blake

(10) Patent No.: US 7,845,521 B2
(45) Date of Patent: Dec. 7, 2010

(54) MECHANICALLY PRESSURIZED DISPENSER SYSTEM

(75) Inventor: William S. Blake, Linwood, NJ (US)

(73) Assignee: Alternative Packaging Solutions, LLP, Lake Saint Louis, MO (US)

( * ) Notice: Subject to any disclaimer, the term of this patent is extended or adjusted under 35 U.S.C. 154(b) by 1119 days.

(21) Appl. No.: 10/487,298

(22) PCT Filed: Aug. 20, 2002

(86) PCT No.: PCT/US02/26547

§ 371 (c)(1),
(2), (4) Date: Feb. 20, 2004

(87) PCT Pub. No.: WO03/015930

PCT Pub. Date: Feb. 27, 2003

(65) Prior Publication Data

US 2004/0238572 A1 Dec. 2, 2004

(51) Int. Cl.
*B65D 88/54* (2006.01)

(52) U.S. Cl. ..... 222/321.5; 222/207; 222/321.8; 222/321.9; 222/340; 222/377; 222/383.2

(58) Field of Classification Search ..... 222/1, 222/321.5, 321.7, 207, 321.8, 209, 321.9, 222/377, 379–380, 383.2, 340, 402.1, 402.2
See application file for complete search history.

(56) References Cited

U.S. PATENT DOCUMENTS 3,777,945 A * 12/1973 Nozawa et al. ..... 222/394
3,790,034 A * 2/1974 Horvath ..... 222/153.13
3,797,748 A * 3/1974 Nozawa et al. ..... 239/321
3,799,448 A * 3/1974 Nozawa et al. ..... 239/321
4,147,280 A * 4/1979 Spatz ..... 222/179.5
4,167,941 A 9/1979 Capra et al.
4,174,052 A 11/1979 Capra et al.
4,174,055 A 11/1979 Capra et al.
4,192,442 A 3/1980 Bastian et al.
4,222,500 A 9/1980 Capra et al.
4,387,833 A 6/1983 Venus, Jr.
4,423,829 A 1/1984 Katz
4,485,943 A * 12/1984 Czech ..... 222/256

(Continued)

FOREIGN PATENT DOCUMENTS

GB 1026086 4/1966

(Continued)

OTHER PUBLICATIONS

Search report for Singapore Appl. No. 200603391-4 dated Oct. 7, 2009.

*Primary Examiner*—Frederick C. Nicolas
(74) *Attorney, Agent, or Firm*—Bryan Cave LLP

(57) ABSTRACT

Mechanically pressurized dispensing systems are disclosed that are manually charged by the user and that dispense substances from a pressurized dispenser as an aerosol. The dispensing system comprises in various embodiments mechanical pressurization assemblies, and particularly an actuator assembly and a collar cap assembly. Preferred embodiments incorporate a spindle and a piston to mechanically charge the dispensing system when an actuator housing of the actuator assembly is manually rotated. Other dispenser systems are disclosed providing a threaded piston utilized in the mechanical charging of the dispensing system. Methods of pressurizing dispensing systems and other methods are also disclosed.

9 Claims, 16 Drawing Sheets

U.S. PATENT DOCUMENTS

| | | | | |
|---|---|---|---|---|
| 4,538,748 | A * | 9/1985 | Ford et al. | 222/153.13 |
| 4,872,595 | A | 10/1989 | Hammett et al. | |
| 5,183,185 | A | 2/1993 | Hutcheson et al. | |
| 5,549,223 | A | 8/1996 | Hori | |
| 6,405,903 | B2 * | 6/2002 | Stadelhofer | 222/309 |
| 6,708,852 | B2 * | 3/2004 | Blake | 222/321.5 |
| 2002/0011530 | A1 | 1/2002 | Fuchs | |

FOREIGN PATENT DOCUMENTS

| | | |
|---|---|---|
| GB | 2005344 A | 4/1979 |
| WO | WO 92/14656 | 2/1992 |

* cited by examiner

MECHANICALLY PRESSURIZED DISPENSER SYSTEM

CROSS-REFERENCES TO RELATED APPLICATIONS

This application is the National Stage of International Application No. PCT/US02/26547, filed Aug. 20, 2002, which claims the benefit of U.S. Non-Provisional application Ser. No. 09/933,574, filed Aug. 20, 2001, each hereby incorporated by reference.

FIELD OF THE INVENTION

The present invention relates to dispensers generally, and more specifically, to aerosol dispensers that are mechanically pressurized. The invention provides a mechanically pressurized dispensing system especially applicable to dispensers manually charged by the user. Further, the present invention may be especially applicable to the dispensing of substances from a pressurized dispenser as an aerosol.

BACKGROUND

Aerosol dispensers have been in use for more than fifty years, and continue to gain in popularity because of the convenience of their use. However, many of those dispensers rely upon chemical propellants, including chloro-fluorocarbons and hydrocarbon compounds to pressurize the product. The use of chemical pressurizing agents creates special problems, including safety concerns in filling, shipping, handling, storing, using and disposing the pressurized, and often flammable containers. Another set of concerns involves questions relating to the effect of certain pressurizing chemical agents upon the earth's ecosystem, including on the ozone layer, and questions concerning the effect of the release of volatile organic compounds into the atmosphere. Accordingly, there has been great interest in the development of aerosol dispensers that do not use chemical propellants, but which also retain the conveniences of use associated with the chemically charged dispensers.

Among the alternatives to chemically pressurized aerosol dispensers are various mechanically pressurized models using finger pumps and triggers. These typically require a continued vigorous pumping to produce a continuous spray, and, as a result, are inconvenient to use. Further, the duration of the spray is in most instances limited by (1) the length of the stroke of the pump or trigger, (2) the fact that the pressure of the spray in most instances does not remain constant during a discharge cycle but decreases rapidly near the end of the cycle with the spray becoming a wet stream or dribble, and (3) the fact that the device must generally be operated in an upright position. In addition, many of the finger-operated pumps are not capable of producing a fine mist or suitably atomized spray for use with such products as cosmetics and hair sprays. As a result, such devices only partially solve the problem of providing a convenient, yet safe alternative to chemically pressurized aerosol dispensers.

Other alternatives to chemically pressurized dispensers include various mechanically pressurized models that obtain prolonged spray time by storing a charge without the use of chemical propellants. Such "stored charge" dispensers include types that are mechanically pressurized at the point of assembly, as well as types that may be mechanically pressurized by an operator at the time of use.

Stored charge dispensers that are pressurized at the point of assembly often include a bladder that is pumped up with product. Examples include those described in U.S. Pat. Nos. 4,387,833 and 4,423,829.

Stored charge dispensers that are pressurized by an operator at the time of use typically include charging chambers that are charged by way of screw threads, cams, levers, ratchets, gears, and other constructions providing a mechanical advantage for pressurizing a product contained within a chamber. This type of dispenser will be referred to as a "charging chamber dispenser." Many ingenious charging dispensers have been produced. Examples include those described in U.S. Pat. No. 4,872,595 of Hammett et al., U.S. Pat. No. 4,222,500 of Capra et al., U.S. Pat. No. 4,174,052 of Capra et al., U.S. Pat. No. 4,167,941 of Capra et al., and U.S. Pat. No. 5,183,185 of Hutcheson et al., which is expressly incorporated by reference herein.

While some of the prior stored charge dispensers avoid some or all of the difficulties of the finger pump or trigger dispensers, the stored charge dispensers tend to have drawbacks of their own. In the devices pressurized at the point of assembly, the charging chamber is often an elastic bladder that remains charged during the life of the product, degrading over time, and these devices typically cannot be refilled with product. In the devices pressurized by an operator at the time of use, the charging chamber devices have been relatively difficult to manufacture due the large number of interrelated working parts required, and/or the fact that they are composed of parts not readily suited to high quantity, high yield injection molding production techniques, and/or the fact that they are required to be used with specially designed containers.

These drawbacks have tended to make the charging chamber dispensers expensive and not commercially feasible for mass market applications, and have tended to make other stored charge dispensers less than completely satisfactory substitutes for chemically pressurized dispensers. Accordingly, existing stored charge and charging chamber dispensers have only partially solved the problem of providing a convenient, yet safe alternative to chemically pressurized aerosol dispensers.

The current invention is a charging chamber dispenser that possesses specific improvements so that it combines convenience of use with commercial feasibility. It is believed that this is, finally, a non-chemical aerosol dispenser that retains the desirable features commonly associated with chemical aerosols, and is, therefore, a non-chemical aerosol dispenser that can attain widespread vendor and customer acceptance.

SUMMARY OF THE INVENTION

Accordingly, the mechanically pressurized aerosol dispensing system of this invention in one of the preferred embodiments consists essentially of: (a) a cap which houses a piston; (b) an actuator moveably attached to the cap, forming together with the cap a dispensing head assembly; and (c) an expandable elastic reservoir. The system is fitted over a standard container holding a liquid product, and includes a dip tube assembly to draw liquid into the dispensing head assembly, including an aerosol nozzle and valve, to release the contents out of the dispensing head assembly.

Complementary screw threads on the cap and actuator are selectively pitched so that a short twist of the threaded cap raises the piston, opening a charging chamber within the dispensing head assembly. This creates a vacuum with the resulting suction pulling the product up through the dip tube to fill the charging chamber. Twisting the cap in the opposite direction lowers the piston in a downstroke which closes the charging chamber, forcing the product into the expandable elastic reservoir. The reservoir expands under pressure, holding the product for subsequent discharge. Pushing a button, which is part of the standard valve assembly in the cap, releases the product through the nozzle.

The general working of the system briefly summarized above is enhanced by several specific improvements, including: (a) use of a snap-in piston so that the piston and the cap may be separately molded, allowing different materials for each and easier mold forms; (b) use of a container which is a separate piece from the dispensing head assembly, permitting easy filling of the container, and taking advantage of ordinary bottles and standard bottling technology; (c) use of a reservoir, piston and actuator in such a way as to realize the additional advantages of establishing a one-way valve mechanism for sealing the dip tube on the downstroke cycle, and also establishing a drain back mechanism for discharging undispensed product back into the container without the need of extra parts for either function, (d) use of a piston sealing mechanism which produces a tight seal while maintaining a low coefficient of friction so as to make the mechanical twisting motions of the cap and actuator easy, and (e) use of a two-way valve mechanism for providing a positive shut off to reduce dribbling or seeping, while also preventing product build up behind the nozzle.

These and other specific improvements (and other embodiments) will be described in more detail later, and their significance will be explained. In summary, it is the cooperation of such elements as these in the system of this invention which results in a non-chemical aerosol that works from any position/orientation, even upside down, that does not require a finger pump to actuate, and that can be fitted to a wide variety of standard disposable or reusable containers. Further, the system of this invention produces a longer duration spray which does not become a wet stream or dribble near the end of the cycle, and a finely atomized high pressure spray which does not take inordinate mechanical force to charge. The system of this invention is simple and uses relatively few parts, all of which can be easily fabricated from existing materials and can be injection molded with existing mold techniques.

It is a specific objective of the system of this invention to solve substantially all of the problems that have, until now, prevented non-chemical aerosol dispensers from being widely accepted as the replacement for chemically pressurized aerosol dispensers.

DETAILED DESCRIPTION OF THE INVENTION

With the above summary in mind, it may now be helpful in fully understanding the inventive features of the present invention to provide in the following description a thorough and detailed discussion of a number of specific embodiments of the invention.

Figure 1:
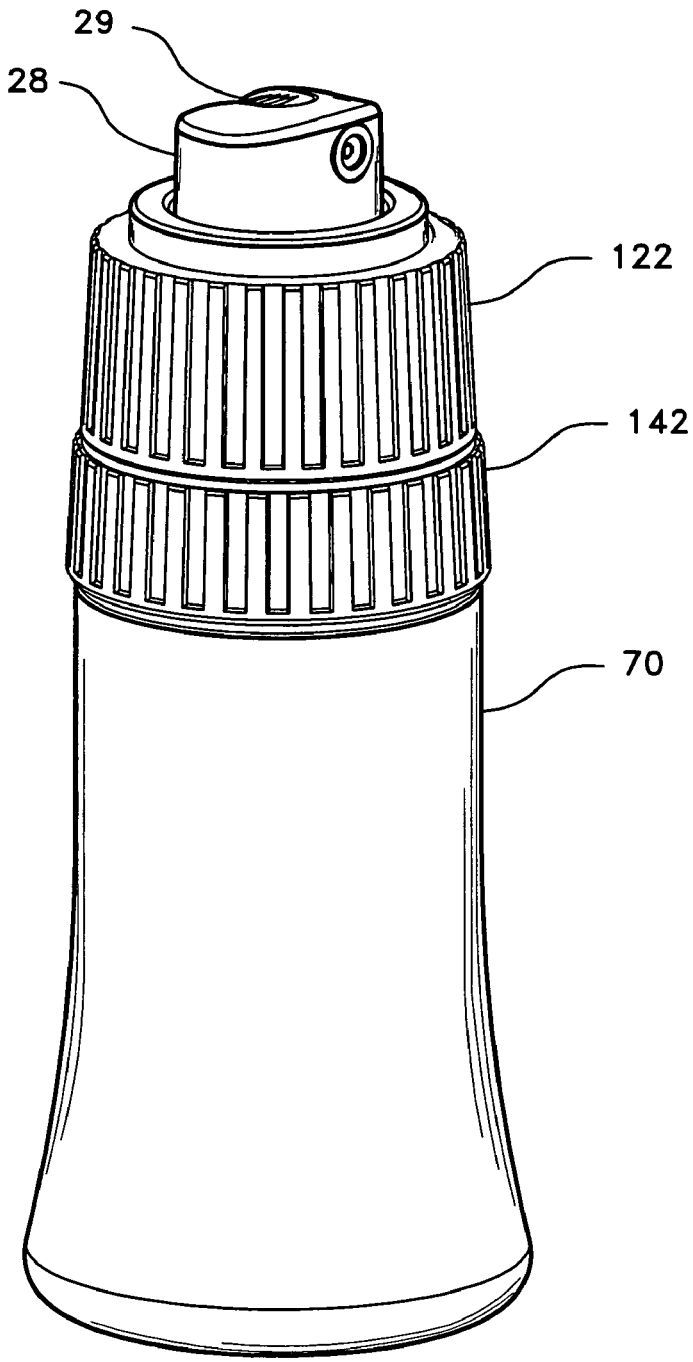
FIG. 1 is an offset front view of this invention particularly featuring the actuator, the actuator housing, and the collar cap.
Figure 2:
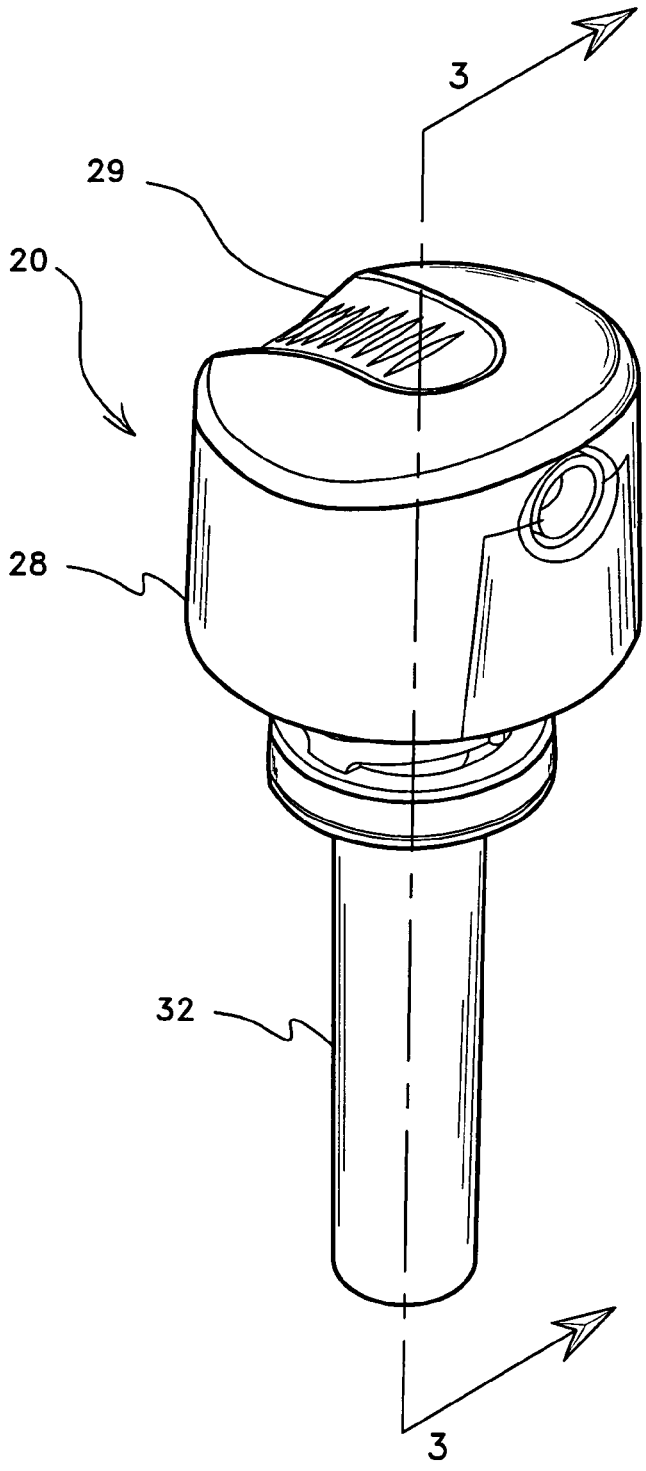
FIG. 2 is a front view of the actuator assembly of this invention shown here without a mechanical break-up unit (MBU).
Figure 3:
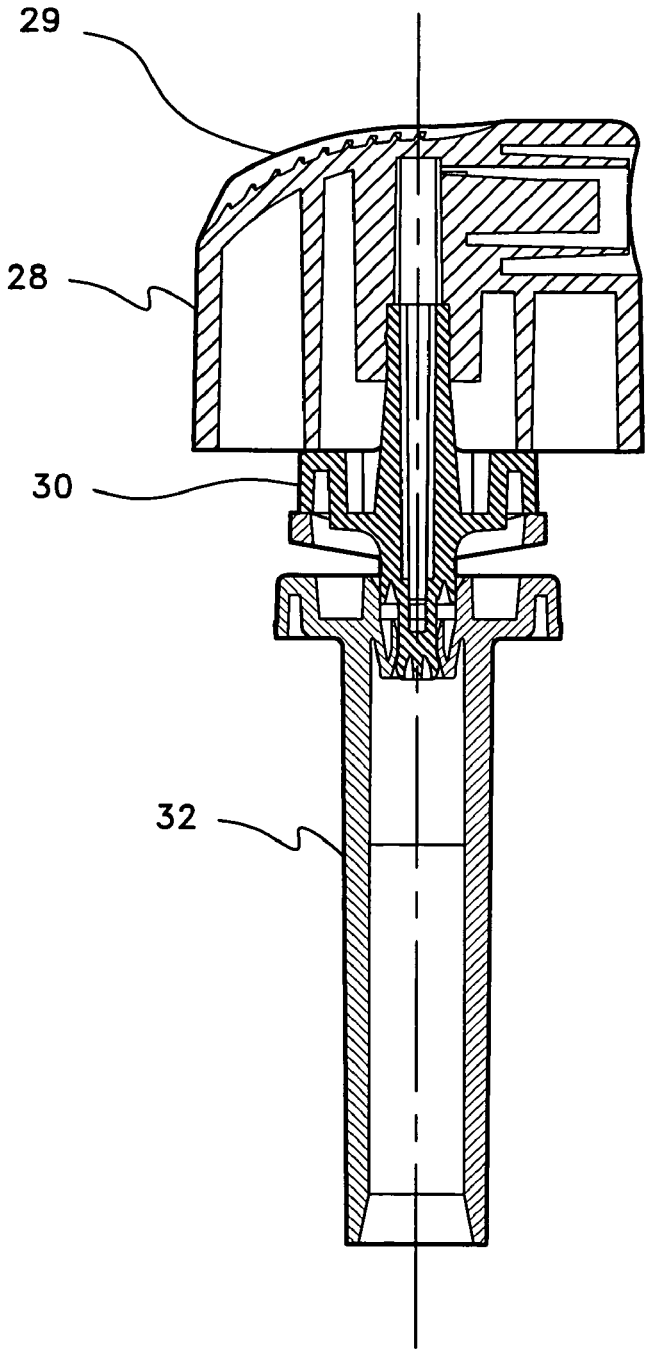
FIG. 3 is a sectional side view of the actuator assembly of FIG. 2, again shown without an MBU.
Figure 4:
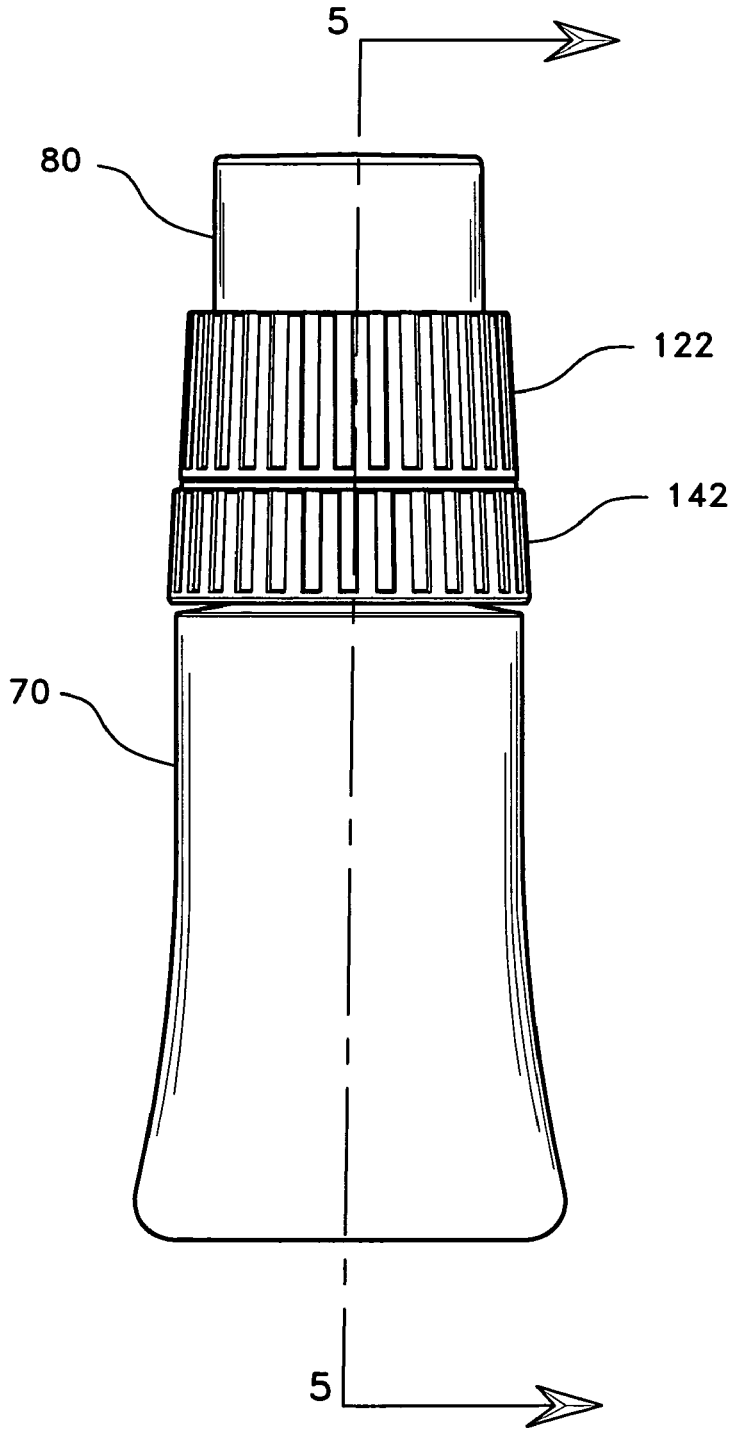
FIG. 4 is a side view of this invention showing the overcap, the actuator housing, the collar cap, and the container.
Figure 9:
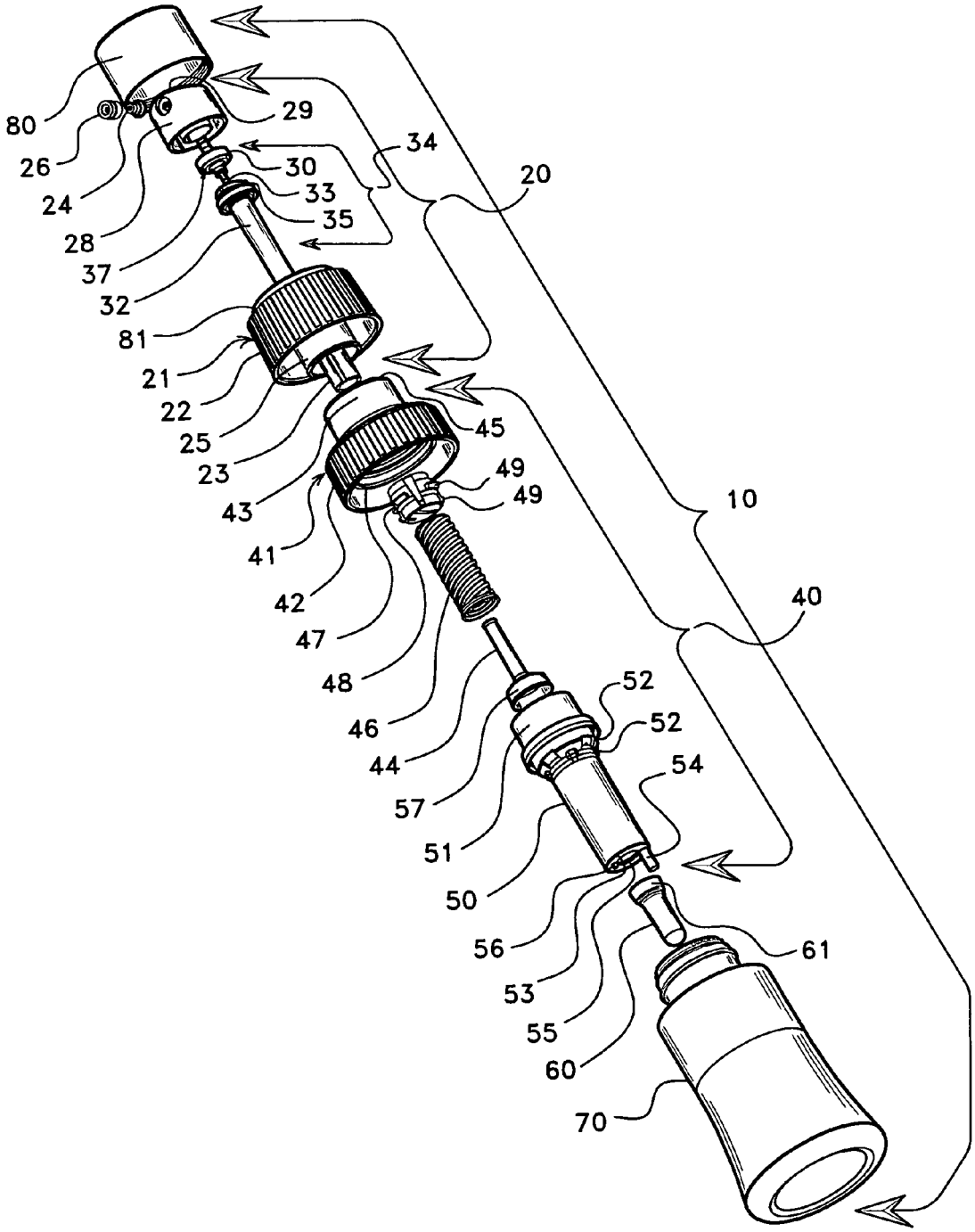
FIG. 9 is a an exploded view of the individual components that together comprise the basic SHA model of FIG. 8.

Most generally, as shown variously throughout the figures for purposes of illustration, it may be seen in overview that a non-chemical aerosol dispenser system referenced generally as dispenser system 10, for example as shown in FIG. 9, may generally comprise an actuator assembly 20 (shown in FIGS. 2 and 3 without an actuator housing 22). Embodiments of a dispenser system may comprise a collar cap assembly 40, shown in FIG. 9 to include a threaded collar cap 42 housing a piston 44 in combination with a spindle 46, and interconnected with a cylindrical housing 50, a piston collar 48, and an expandable elastic reservoir 60. Although a cylindrical housing is provided in some preferred embodiments, other shapes of housing 50 may be provided in accordance with the present invention.

Figure 7:
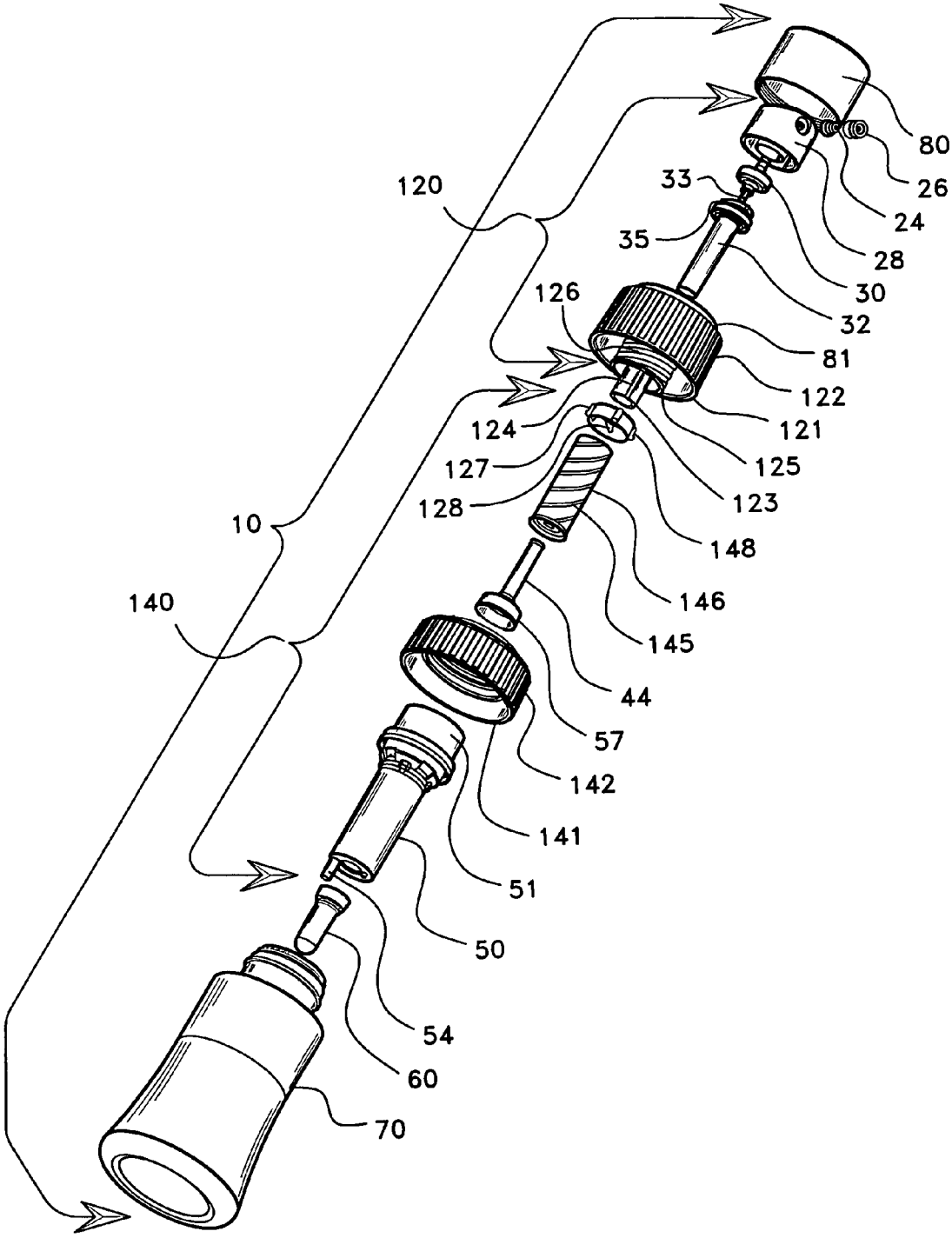
FIG. 7 is a an exploded view of the individual components that together comprise the DHA model of FIGS. 5 and 6.
Figure 11:
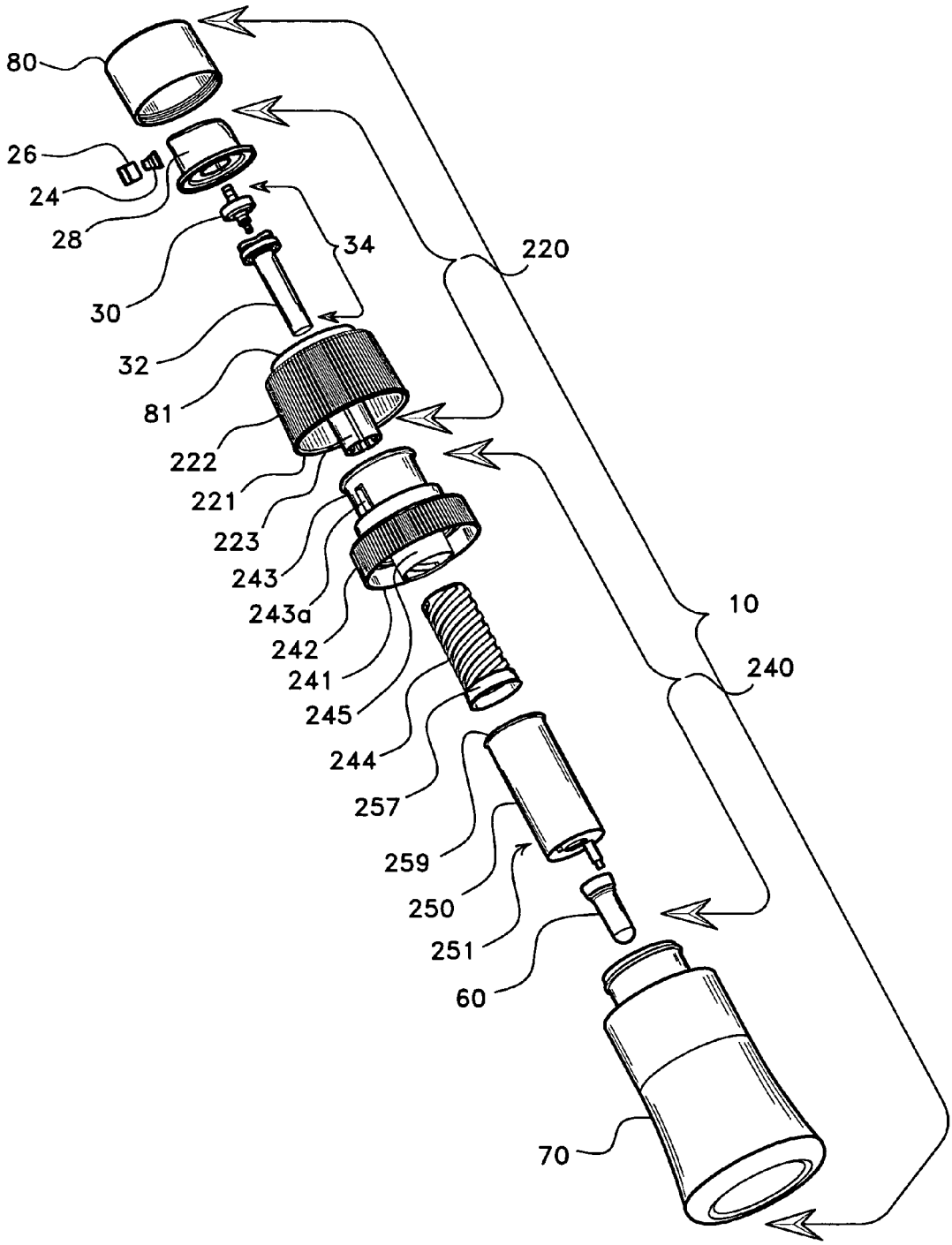
FIG. 11 is a an exploded view of the individual components that together comprise a third embodiment of the dispenser invention shown in FIG. 4, the simplified single helix action (SHA) model, specifically showing the elimination of several parts as compared to the embodiments shown in FIGS. 7 and 9.

As shown in FIGS. 7, 9 and 11, the generally referred to dispenser system 10 fits onto the collar of a standard container 70. In all of the disclosed embodiments discussed below, the container 70 may be any standard container, and it does not need to be specially made to withstand a minimum gas pressure. Since the container 70 is not pressurized, it also does not need to be cylindrical or round in shape, nor does it need to be constructed with heavy or thick material. In fact, there are no apparent geometrical limitations placed on the container 70, thus enabling the dispenser system 10 to have a virtually unlimited range of possible consumer uses, including the possibility of its use with food products. Moreover, the container 70 can be disposable or reusable, and it can be filled and refilled readily with ordinary techniques known to those persons skilled in the art. Further, unlike chemically propelled aerosols, the current invention is readily adaptable to a wide variety of products characterized by a wide variety of viscosities, surface tensions, formulations, etc., and it can further be configured in a wide variety of product-specific or consumer-specific packaging options. Such container interchangeability is well known by persons skilled in the art and is not further described herein.

The expandable elastic reservoir 60 of the disclosed embodiments discussed below is shown in FIGS. 7, 9 and 11, and is described as an elastomeric bladder, but it may be any kind of reservoir which can expand under pressure, thus storing a force. Accordingly, the reservoir 60 should be understood to represent, not only the elastomeric bladder of some embodiments of the present invention, but more generally, a means for resistably expanding a reservoir under hydraulic pressure, including not only elastic reservoir containers, but also structures consisting of spring-loaded pistons and equivalent devices mounted within rigid and semi-rigid reservoir containers, including containers having springs embedded within, or affixed to, flexible materials. In fact, a spring-loaded reservoir would represent a viable alternative that would also represent a less expensive component Such structures, however, are well known by those skilled in the art and are not further described herein.

Several embodiments of this invention are now disclosed, each comprising a group of interconnected components, and each further comprising a standard container 70, an elastomeric bladder 60, and an actuator assembly 20 using a fitment 24 in combination with a fitment 26 as may be shown variously in FIGS. 5-9 and 11-13 and as described above.

Figure 5:
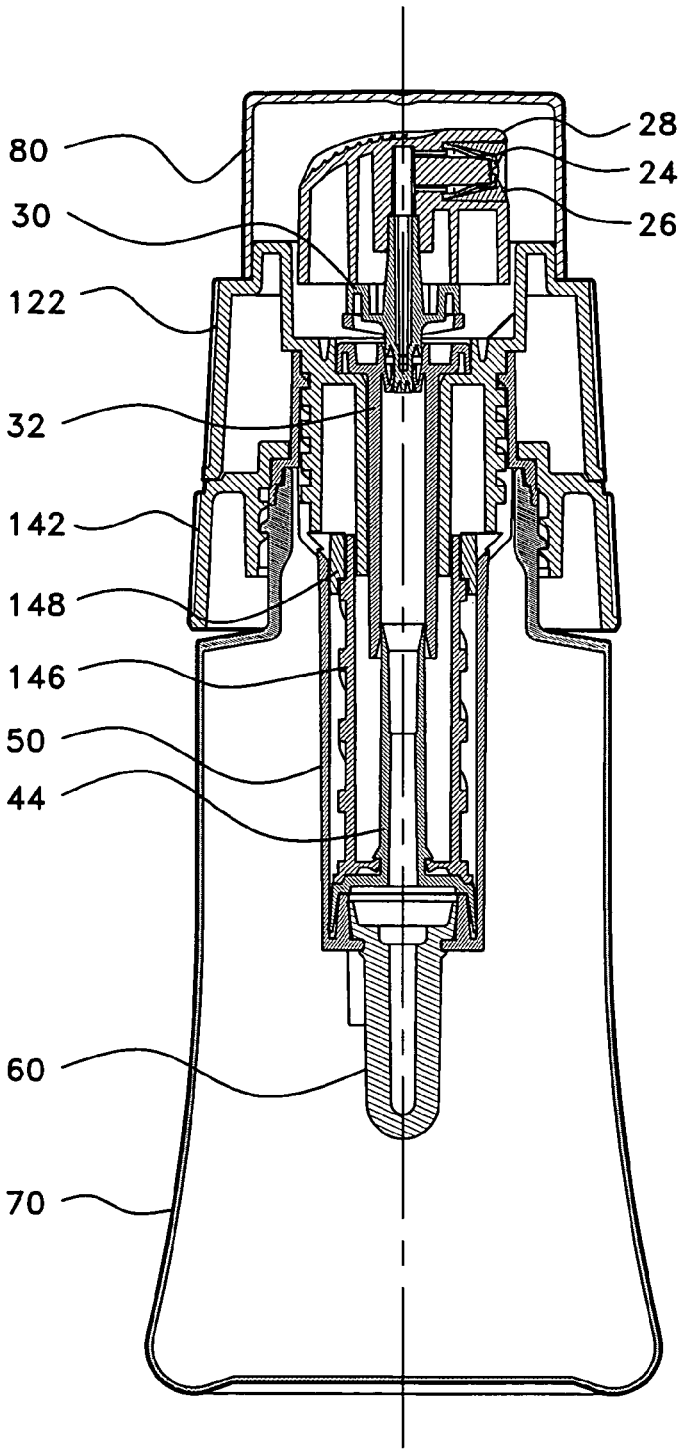
FIG. 5 is a sectional side view of one embodiment of the dispenser invention shown in FIG. 4, specifically the double helix action (DHA) model, which is shown here with the piston in the down position.
Figure 6:
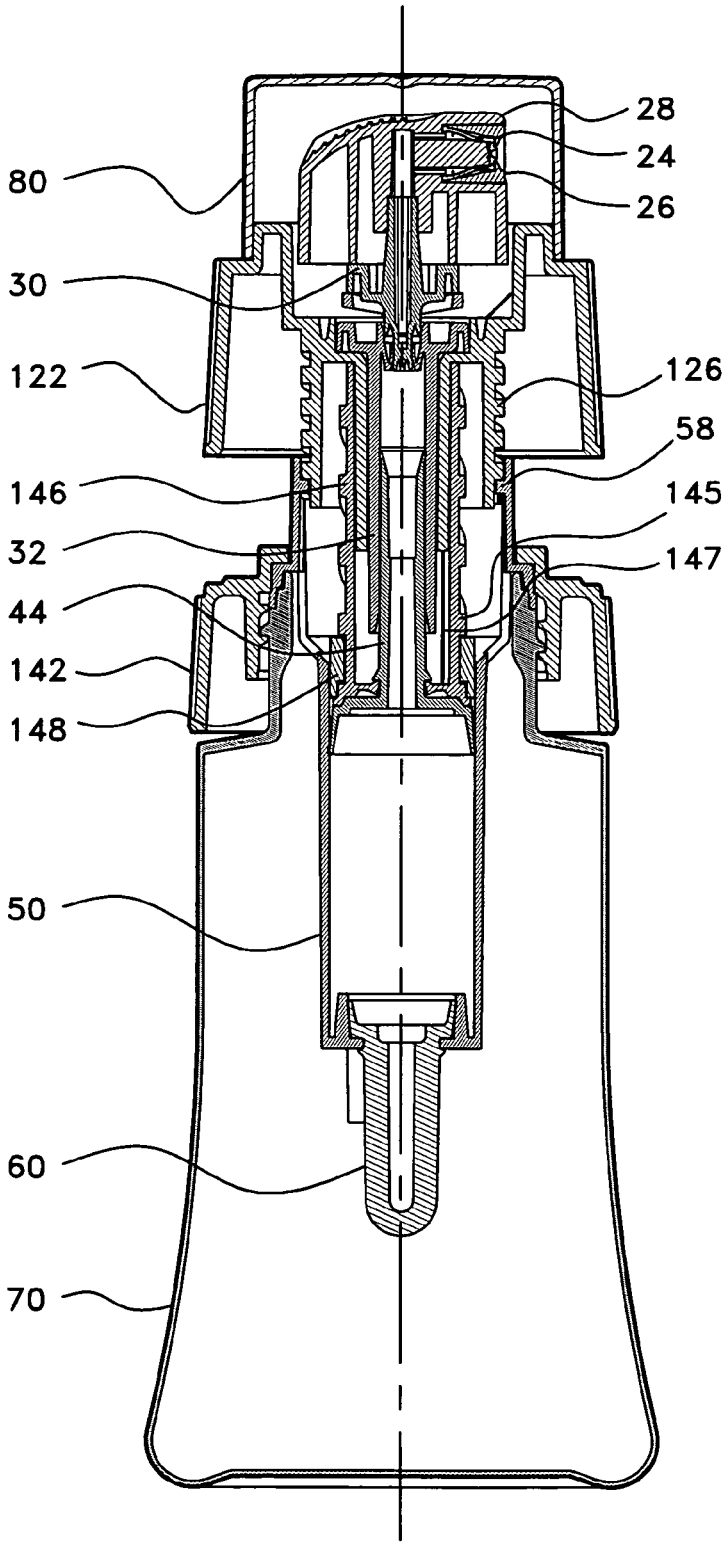
FIG. 6 is a sectional side view of the DHA model of FIG. 5, but is shown here with the piston in the up position.
Figure 8:
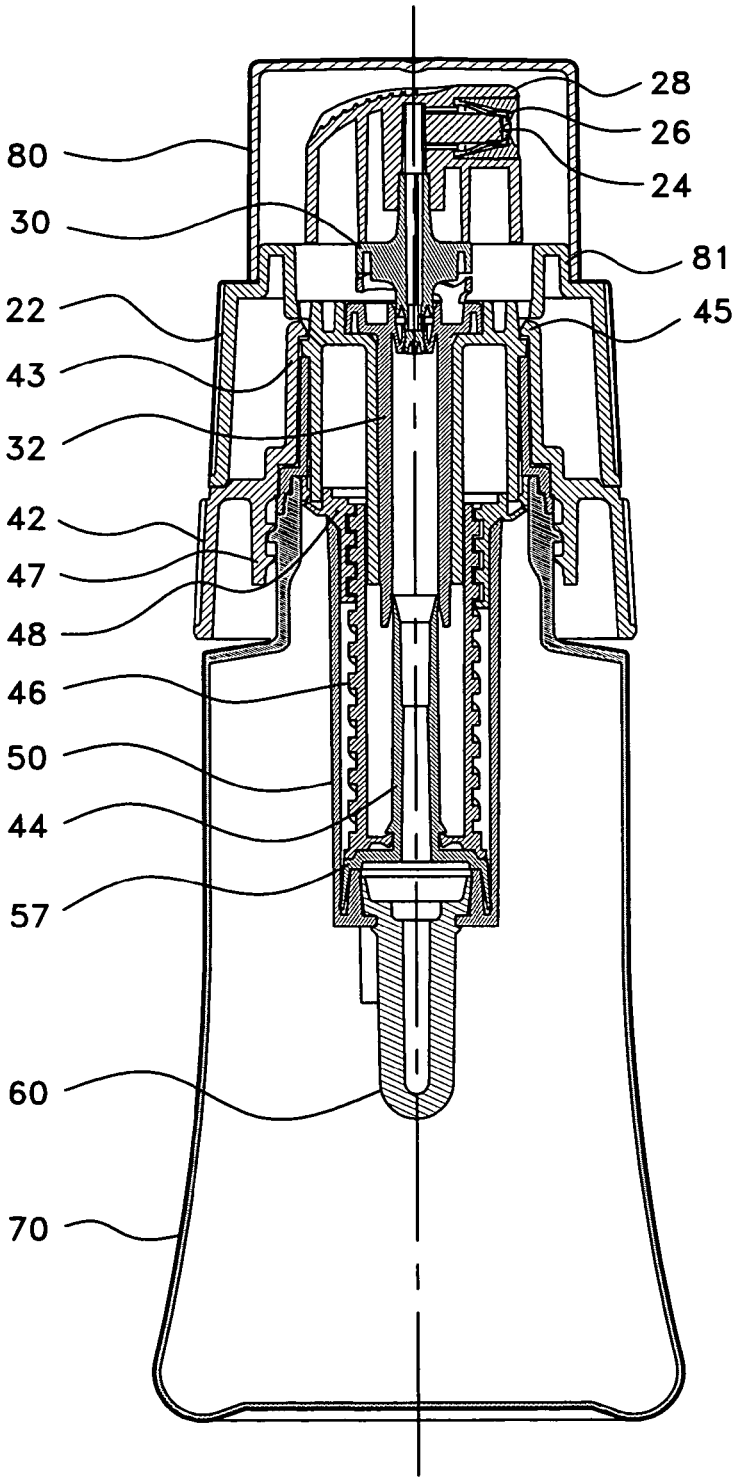
FIG. 8 is a sectional side view of a second embodiment of the dispenser invention shown in FIG. 4, specifically the basic single helix action (SHA) model, which is shown with the piston in the down position.

One embodiment, having features that may be incorporated in the design and referred to as having double helix action (DHA), is shown in FIGS. 5-7. A second embodiment, having features that may be incorporated in the design and referred to as having single helix action (SHA), is shown in FIGS. 8 and 9. Both embodiments may be comprised of common components, with minor variances in the geometries of some of the individual components. Both embodiments specifically incorporate a piston head 57 and cylindrical housing 50, as illustrated generally in FIGS. 7 and 9, that are each smaller in their respective diameters then those disclosed in previously patented dispensers, which allow DHA and SHA embodiments to generate longer upward and downward bore strokes than those generated by previously patented dispensers. The longer bore strokes may be considered critical to the efficiency of some preferred embodiments of this invention. The longer strokes allow additional product initially to be hydraulically drawn into the cylindrical housing 50, and subsequently forced into the elastomeric bladder 60, thus ultimately allowing the product to be dispensed with a longer duration spray than that generated by previously patented dispensers. Further, DHA and SHA embodiments featuring piston heads 57 and cylindrical housings 50 with smaller diameters respectively, require the application of less force to overcome the frictional forces working against the downstroke of the piston 44, thus making it easier for the user to operate DHA and SHA embodiments, thus accommodating a wider range of users with otherwise limiting physical conditions, i.e. arthritis.

Figure 12:
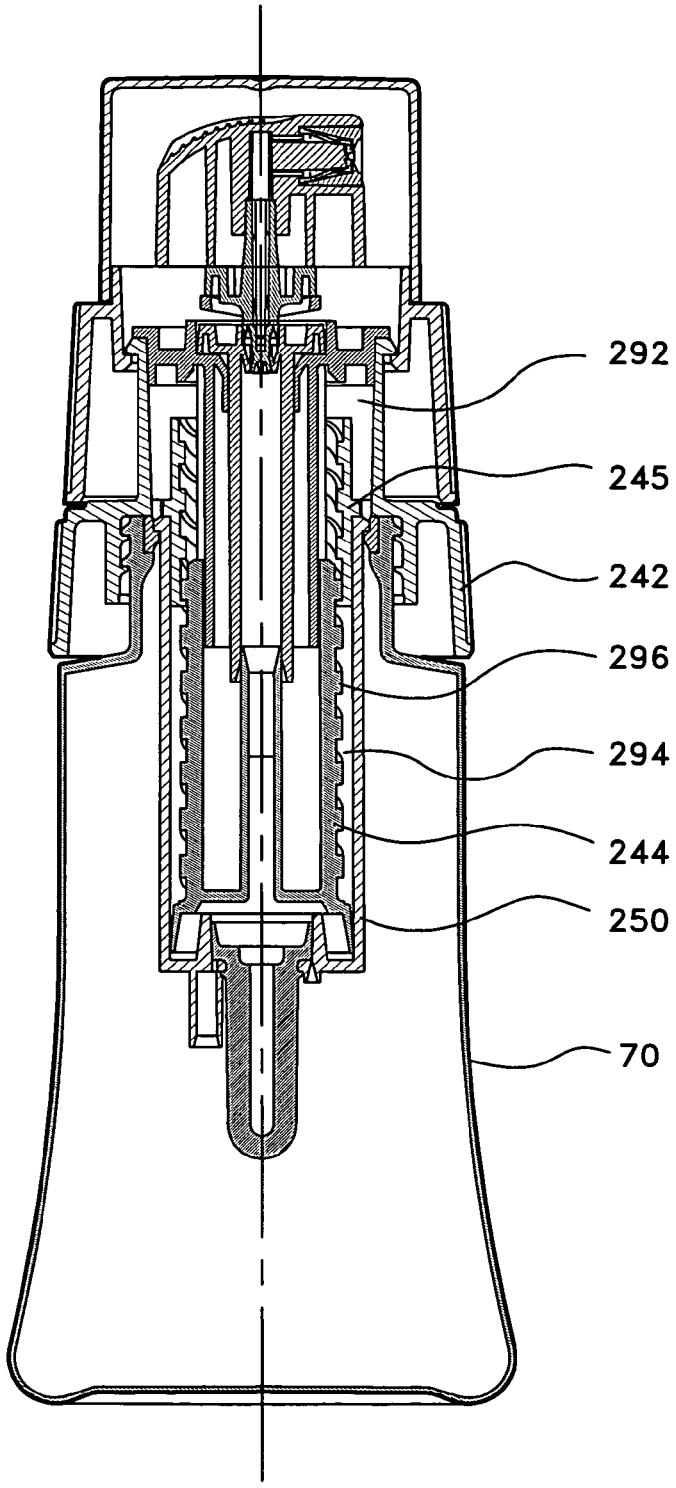
FIG. 12 is a sectional side view showing the embodiment of FIG. 11 with the piston in the down position.
Figure 13:
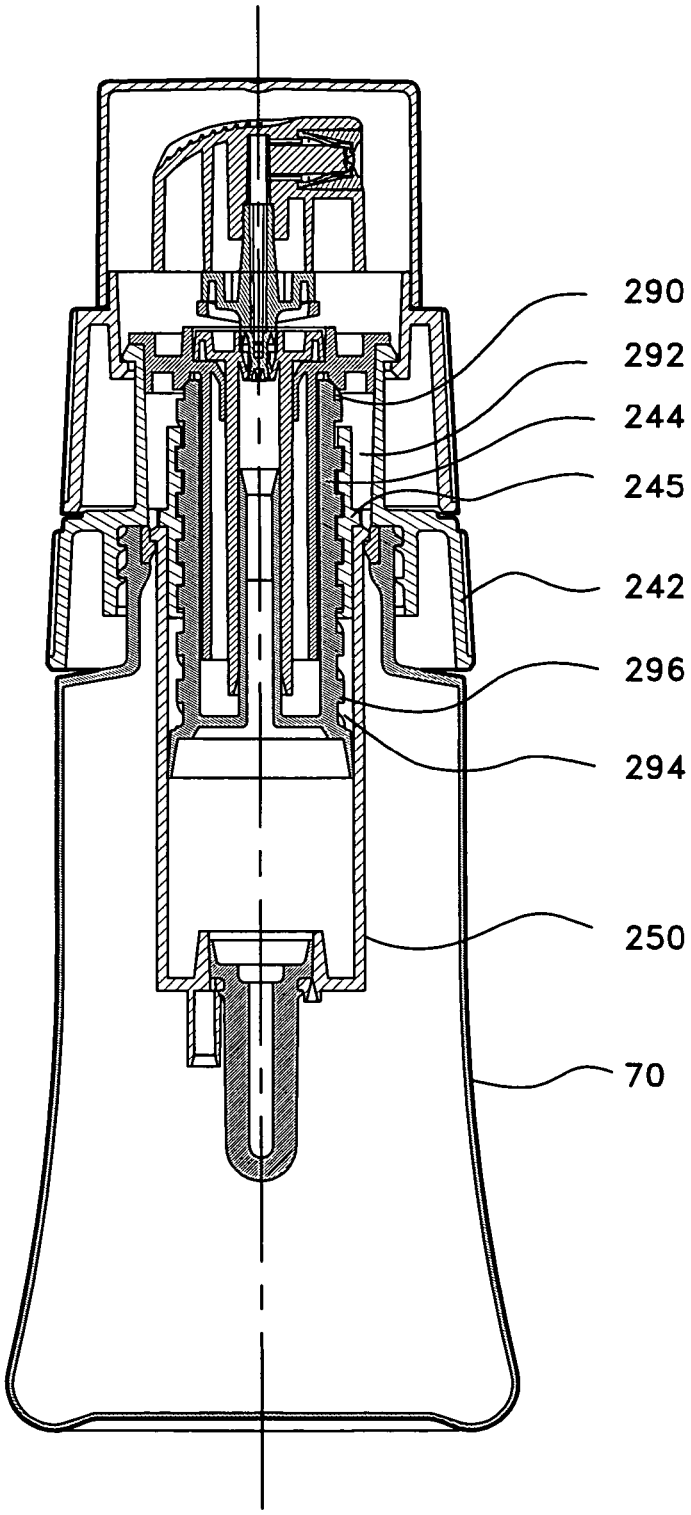
FIG. 13 is a sectional side view showing the embodiment of FIG. 11 with the piston in the up position.

A third embodiment, shown in FIGS. 11-13 and referred to as a second SHA embodiment, is manufactured using fewer components than the previously described SHA embodiment of FIGS. 8 and 9, and it features a piston head 257 and cylindrical housing 250 with slightly larger diameters respectively than either the DHA embodiment or the SHA embodiment of FIGS. 8 and 9. In some preferred embodiments of the second SHA design, the piston head 257 and cylindrical housing 250 have diameters of approximately 1.0 inch as compared to the piston head 57 and the piston housing 50 of the DHA and the first SHA embodiments that may have diameters, in some preferred embodiments, measuring approximately 0.782 inches. This increase in diameter of each component 250, 257, while in some embodiments simultaneously leaving the size and spacing of the threads of the piston 244 and the grooves of the piston collar cap 245 unchanged relative to the size and spacing of spindle 46, 146 and the grooves of the piston collar cap 48, 148 of the other embodiments, leaves the length of the piston 244 and the length of the cylindrical housing 251 unchanged. By making this slight modification, the second SHA embodiment is able to increase the amount of product ultimately charged in the elastomeric reservoir 60, thus increasing the duration of the product spray upon activation.

Further, while the increase in the size of the piston head 257 may require a user to apply more force to overcome the frictional forces working against the downstroke of the piston 244, the second SHA embodiment only requires, in some preferred embodiments, one turn of its actuator housing 222 to fully charge the elastomeric reservoir 60 versus the 1¾ turns of the actuator housings 22, 122 for both of the smaller heads 57 shown in FIGS. 7 and 9. In the three embodiments, the disclosed diameters of the respective piston heads 57, 257 and cylindrical housings 50, 250 are exemplary of various embodiments of the present invention. Those persons skilled in the art will appreciate that by changing the relative diameter sizes of the piston heads 57, 257 and the cylindrical housings 50, 250, in accordance with the present invention, the amount of product hydraulically withdrawn from the container 70 and forced into the elastomeric reservoir 60 will be varied accordingly. Alternately, changes in the relative pitch of the threads of the spindle 46, 146 and the grooves of the piston collar cap 48, 148 and/or changes in the relative length of the piston 44 or the cylindrical housing 50, will likewise vary the ultimate product output as those persons skilled in the art will appreciate upon an understanding of the present invention and as will be discussed in more detail below.

In some embodiments, generally, and in both the DHA embodiment shown in FIGS. 5-7 and the SHA embodiment shown in FIGS. 8 and 9, the following like components of each embodiment: an actuator housing 22, a fitment 24, a fitment 26, an actuator 28 (referred to in some embodiments as shown in FIGS. 8, 12, 13, 15, and 16 as a mechanical break-up unit MBU), a valve stem seal 30, a spring valve retainer 32, a collar cap 42, 142, a piston 44, a spindle 46, 146, a piston collar 48, 148, a cylindrical housing 50, a reservoir bladder 60, and an overcap 80. The actuator assembly 20, 120 as shown in the embodiments of FIGS. 7 and 9 generally comprises the actuator housing 22, 122, the fitment 24, the fitment 26, the actuator 28, the valve stem seal 30, and the spring valve retainer 32. Such an actuator assembly creates a discharge pathway through which product is dispensed. This results in a product that is dispensed in a fairly constant pattern that then shuts off abruptly, allowing negligible product dribbling as the pressure decreases and minimal product build-up behind the valve.

Figure 10:
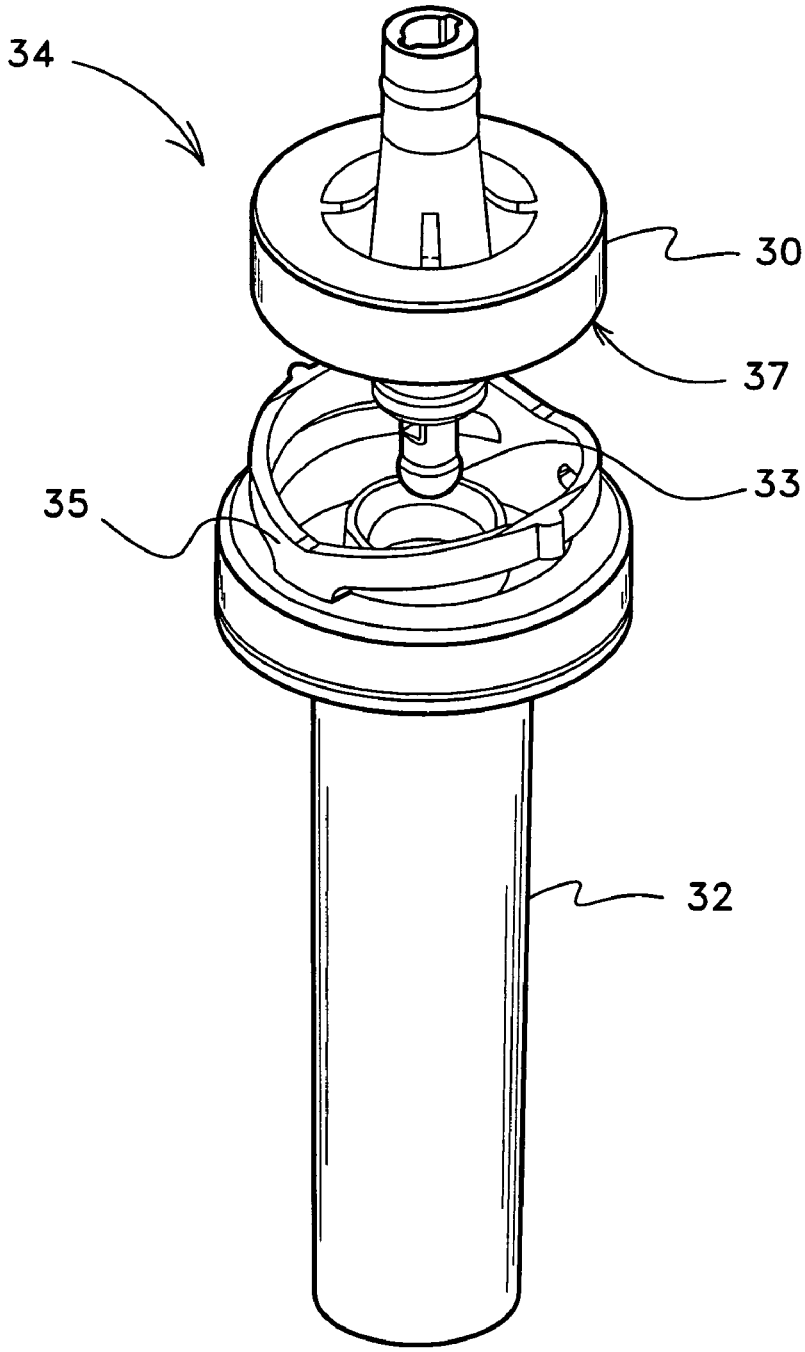
FIG. 10 is a blown-up representation of the two-part valve mechanism that is integral to each of the embodiments of this invention.

Referring to the figures generally and to FIG. 9 and FIG. 10 specifically, one novel feature of this invention that is common to the embodiments described previously is the introduction of a valving mechanism 34, comprised of the valve stem seal 30 and the spring valve retainer 32, upon which the atomizing actuator 28 sits. Once the reservoir bladder 60 has been charged up to the desired capacity, the valving mechanism 34 stands ready to be activated, which occurs when the button 29 on the actuator 28 is depressed, thus allowing the contents of the reservoir 60 to discharge. The two components 30, 32 of the new valving mechanism 34 essentially replace five components that have been standard in most other previously disclosed aerosol valves. Common to the prior designs, stem valves just rested within the spring valve retainers while the actuators were locked or retained into position to inhibit the valve action via two wings at the base edge, which retained the assembly by snapping into windows molded into the upper body structure. The new valving mechanism 34 eliminates these unnecessary retention means by virtue of the geometry of the valve stem seal 30, which has a bulbous contoured tip 33 that flexes into a pocket within the spring valve retainer 32, thus seating itself so as to be permanently retained. Further assisting with the retention of the valve stem seal 30 within the spring valve retainer 32 is the leaf spring 35 that flexes upon the downward pressure of, and engages the outer lip 37 of, the valve stem seal 30.

Referring to FIGS. 7, 9 and 11, the actuator housings 22, 122, 222 and the collar caps 42, 142, 242 are part of the pressurizing mechanism of this dispenser system 10. In preferred embodiments, components 22, 122, 222, and 42, 142, 242 are each essentially circular in shape, and along with the rest of the components of the dispenser system 10 (with the exceptions of the fitment 24 and the fitment 26), are positioned symmetrically around a common vertical axis. Actuator housings 22, 122, 222 and the collar caps 42, 142, 242 also each feature an alternating grooved surface upon their respective circular outer walls 21, 121, 221, and 41, 141, 241 so as to facilitate a non-slipping grip by the consumer. The pressurizing mechanism is activated, in some preferred embodiments, when a system user grips the outer wall 21, 121, 221 of the actuator housing 22, 122, 222 with one hand, grips the outer wall 41, 141, 241 of the collar cap 42, 142, 242 or alternatively, the container 70 with the other hand, and proceeds to twist the actuator housing 22, 122, 222 counter-clockwise. In the embodiments of FIGS. 7, 9 and 11, the pressurizing mechanism is further activated, as further described below, and the twisting steps are the same as previously described for the counter-clockwise direction, i.e., the actuator housing 22, 122, 222 action is reversed, that is, it is twisted clockwise while the collar cap 42, 142, 242 or the container 70 is held in order to complete the pressurizing or priming of the dispenser system 10.

In the embodiments of FIGS. 7, 9 and 11, an inset upper lip 81 of the actuator housing 22, 122, 222 creates an engaging means by which overcap 80 is seated to protect the activating button 29 from accidental discharge while the system 10 is in storage or while it is in transit. Such engaging means can be any of a wide variety of mechanical features that allows the overcap 80 to be securely fastened to the actuator housing 22, 122, 222 and yet also easily removed for operation of the dispenser system 10. Such engaging means are well known to those persons skilled in the arts and will not be further discussed herein.

Referring specifically to FIGS. 5-7, the actuator housing 122 of the DHA model has an inner circular wall 123 that defines a space within its circumference through which the spring valve retainer 32 portion of the actuator assembly 120 is seated. The space within the circumference of the inner circular wall 123 is defined by a diameter that is slightly larger than the diameter of the spring valve retainer 32, such that there is minimal clearance between the two components 123, 32 that creates a minimal frictional force between the two components 123, 32 upon operation of the system 10. Between the grooved outer circular wall 121 and the inner circular wall 123 of the actuator housing 122, there is an intermediate circular wall 125, extending below the outer wall 121 in length, but not extending below the length of the inner wall 123. The intermediate wall 125 is threaded, a feature which gives rise to the "double" helix action observed during the enactment of the pressurizing mechanism as will be further described below.

In various embodiments of the present invention, the pressurizing mechanism is engaged initially by a first action generated by the upstroke of the piston 44, as shown generally in FIG. 6. As particularly shown in the figures, the first action occurs when a user applies an external rotating force that twists the actuator housing 122, engaging grooves 124 of inner circular wall 123 with ribs 147 of spindle 146, thereby providing rotation of spindle 146. Correspondingly, when a user applies an external rotating force that twists the actuator housing 122, threads 126 of intermediate wall 125 engage lugs 58 of outer circular wall 51 of housing 50. In some embodiments, lugs 58 may comprise bayonet lugs, ramp lugs, or the like. The engagement and configuration of the threads 126 and the lugs 58 provide for an upward motion of the actuator housing 122 when the actuator housing 122 is twisted or rotated in a direction. Further, lugs 127 of piston collar 148 engage with one or more elements of cylindrical housing 50, such as windows, and the lugs 128 of piston collar 148 engage with threads 145 of spindle 146, providing an upward motion of spindle 146 and linear travel of piston 44 upon twisting the actuator housing in a direction. Therefore, piston 44, which is connected to the spindle 146, will linearly travel during the upstroke of the piston 44 and spindle 146. As the spindle 146 and piston 44 withdraw from the cylindrical housing 50 during the course of the first action, product is pulled out of the container 70 through the dip tube acceptor port 54 and is deposited within the cylindrical housing 50. The second action commences with the counter-directional twisting of the actuator housing 122 and a corresponding rotation of inner circular wall 123 and spindle 146, a downward motion of actuator housing 122, and a downward motion and linear travel of spindle 146 and piston 44, provided by the mechanical relationships described above. As the spindle 146 and the attached piston 44 travel downward, the product is forced out of the cylindrical housing 50 and into the elastomeric bladder 60, thus priming the dispenser system 10 prior to the activating button 29 being depressed. As will be recognized by persons skilled in the art, the quantity and type of product dispensed by such a system 10 can be varied by changing either the spacing between, and/or pitch of the threads of the spindle 146 and the lugs of the interfacing piston collar 148.

Continuing to refer generally to FIG. 7, similar changes can also be made with respect to the distance between and the pitch of the threads on the intermediate wall 125 of the actuator housing 122. Further, by altering the spacing and pitch of the threads of the spindle 146 and the lugs of the interfacing piston collar 148, as well as the internal threads of the actuator housing 122 and lugs 58 of outer circular wall 51, products of various viscosities, surface tensions, formulations, etc. can be selected for a variety of specific applications. These variations will be discussed in greater detail below in reference to SHA embodiments. In the embodiment of FIG. 7, the double helix action described above results in the deposition of the maximum amount of product within the elastomeric reservoir 60 as well as the maximum amount of product ultimately dispensed.

By contrast, FIG. 9 shows that the intermediate wall 25 of the basic SHA model is essentially smooth and is shaped such that it accepts the upper inner wall 43 of the collar cap 42 so as to more effectively facilitate the twisting of the actuator housing 22 and the collar cap 42 during the pressurizing step, while also providing a significant degree of registration between the two components 22, 42. In both the DHA and the SHA embodiments, the twisting of the actuator housing 122, 22 forces the spindle 146, 46 which is attached to the piston 44, to travel via its threads either upward or downward along the grooves of the piston collar 148, 48, thus mechanically providing the force necessary to withdraw product from the container 70, deposit it first within the cylindrical housing 50 and then ultimately within the elastomeric reservoir 60 to complete the charging of the dispenser system 10. The mechanical advantage to these embodiments, referred to generally as a floating track and rail system designs is that, with minimal effort, a single twist of the two components of the DHA embodiment (or 1¾ turns of the SHA embodiment, which would require the application of even less force by the user) generates a substantially long bore stroke, which translates into the acquisition of a large volume of product, which is then ready to be dispensed. This large volume of product is then capable of being sprayed consistently for a long period of time, such as, in some embodiments, 12-15 seconds, before the mechanical charge built up in the system 10 dissipates. In combination with the non-clogging flexible face actuator assembly's precise shut-off capability, this translates into a mechanical aerosol dispenser that has dispensing qualities comparable to those historically only found in chemical aerosol dispensers.

Referring again to FIG. 9, the upper inner wall 43 of the collar cap 42 of the SHA embodiment is essentially smooth and further includes an inner circular rim 45 formed within the interior of the cap 42 that provides the structure against which the cylindrical housing 50 seats. The collar cap 42 also provides a lower inner circular wall 47, slightly outset from the upper inner wall 43 that has threads upon its interior surface such that the collar cap 42 can be threadably connected with the standard container 70 housing the desired product.

Continuing to view FIG. 9, the outer circular wall 51 of the cylindrical housing 50 of the SHA embodiment defines a space at its top that has a diameter large enough to accept the piston 44, the piston collar 42, and the spindle 46. The circular bottom 53 of the cylindrical housing 50 extends radially inward from the outer circular wall 51. It is not a solid bottom, however, and the inner circular edge 55 of the bottom 53 defines an inner space through which the reservoir bladder 60 protrudes and upon which the piston 44 comes to a final resting position. The cylindrical housing 50 includes several windows 52 that allow for a snap fit connection to the several corresponding lugs 49 of the piston collar 48, provided in some embodiments as wing lugs, so that the piston 44 and spindle 46 are able to move securely up and down within the cylindrical housing 50 along the lugs 128 of the piston collar 48, similar to the travel described for the DHA embodiment above.

The cylindrical housing 50 shown in FIG. 9 further includes a dip tube acceptor port 54 protruding from its bottom as well as a bleed back feature 56, located in this embodiment approximately 180° away, as in substantially opposite from, the dip tube acceptor port 54. The acceptor port 54 allows a dip tube (not shown) to be attached that provides a product pathway from the standard container 70 up into the cylindrical housing 50, from where the product travels up through the actuator assembly 20 during the dispensing cycle. The bleed back feature 56 allows an overcharged reservoir bulb 60 to release some product back into the standard container 70, thus reducing the pressure during the storage of the charge. In this embodiment, the bleed back feature 56 is conical in shape with the apex of the cone consisting of a webbing that, when pierced in the manufacturing process, forms the pathway for fluid to travel from the bulb 60 to the container 70. Those persons skilled in the art will recognize that the geometry of the bleed back feature 56 of the present invention controls the fluid's drop size and the rate at which the drops travel back to the container 70. A wide range of geometrical shapes and sizes of bleed back features 56 can be selected depending on the objectives of each system and the type (i.e., viscosity, formulation, etc.) of product utilized.

FIG. 9 further illustrates the piston 44 itself as a narrow tube seated upon a circular head 57 that is raised up along with the spindle 46 within the cylindrical housing 50 upon an initial twisting of the actuator housing 22, and forced back down into the cylindrical housing 50 until the piston rests upon the cylindrical housing bottom 53 upon a reverse twisting of the actuator housing 22. The up and down motion of the piston 44 within the cylindrical housing 50 provides the mechanical force needed to pull product from the standard container 70 up into the cylindrical housing 50 as described above. From the cylindrical housing 50, the product is forced into the elastomeric bladder 60 upon the downstroke of the piston 44. When the activating button 29 is depressed, the product is dispensed up through the actuator assembly 20. As described above, the piston 44, connected to the spindle 46, travels up and down within the cylindrical housing 50 due to the twisting of the actuator housing 22 that is connectedly joined to the collar cap 42 through the snap fitting of the piston collar 48. This action provides for an upward motion of the piston 44 and spindle 46 in the first directional instance, and a downward motion of the piston 44 and spindle 46 in the second, reversible directional instance.

Continuing to refer to FIGS. 8 and 9, the lip 61 of the reservoir bladder of this SHA embodiment is seated within an upstanding wall 57 extending radially upward from the bottom 53 of the cylindrical housing 50 while the rest of the reservoir bladder 60 protrudes through the space defined by the inner circular edge 55 of the bottom 53. The bladder 60 extends down into the standard container 70. As described above, upon the downward motion of the piston 44 and spindle 46, the reservoir bladder 60 becomes charged with a hydraulic pressure differential created within the cylindrical housing 50. Upon the release of the pressure through the depressing of the activating button 29, the reservoir bladder 60 is discharged and the equalization of the hydraulic pressure differential within the cylindrical housing 50 allows any excess product to be dispensed within the standard container 70. On the upward stroke of the piston 44, product travels through the port acceptor 54 and into the cylindrical housing 50 where it awaits dispensing. The overcap 80, which seats itself over an inset outer retaining wall 81 extending above the actuator housing 22, serves solely to protect the button 29 from accidental discharge prior to use.

Thus with the exception of the geometries of the respective actuator housings 22, 122, the piston collars 48, 148, and the thread patterns on the spindles 46, 146, one embodiment of the SHA design and the DHA design, as illustrated in FIGS. 5-7 and 8-9, may generally comprise like components in combinations that are described above. The advantages created by the two embodiments include the abilities of both to obtain long bore strokes versus the strokes of previously disclosed dispensers. Further, the DHA embodiment, as shown in FIGS. 5-7, exhibits an additional mechanical advantage due to the thread-to-groove or thread-to-lug engagement via two modes that simultaneously move the mechanism down with one twist/turn on the actuator housing 122, and utilizing a back and forth radial motion that produces twice the travel of the piston 44 and spindle 146 within the cylindrical housing 50, thus more readily facilitating the hydraulic charging of the reservoir bladder 60. Further, in some preferred embodiments, and while the stroke takes place, the actuator housing 122 moves upwards by one-half of the entire stroke.

By contrast, the SHA embodiment shown in FIGS. 8-9, may feature the same diameter piston 44 and spindle 46 combination that are used in DHA embodiments, but is differentiated in some preferred embodiments by the reduction by one-half stroke when the upper mode of travel is removed, thereby forcing the lower mode to provide the remaining travel for the other half of the required stroke. Regarding other geometrical and functional aspects, however, the two embodiments may be considered similar.

A second SHA embodiment, shown in FIGS. 11, 12, and 13, may feature a slightly larger diameter piston 244. One difference between this embodiment and the DHA and the SHA embodiments previously described is that it features less components and thus creates a simpler product to manufacture. In a preferred second SHA embodiment, the piston head 257 may have an approximately 1.0 inch diameter versus an approximately 0.782 inch diameter of a piston head 57 in some of the DHA and SHA embodiments previously described. Again, it is important to note that the diameter specified is not intended to be limiting in any way; rather, the relative proportionality of the piston head 57, 257 and cylindrical housing 50, 250 and/or the relative proportionality of the threads of the spindle or piston 46, 146, 244 and the grooves of the piston collar 48, 148, 245 and/or the length of the piston 44, 144, 244 and the length of the cylindrical housing 50, 250 are more important, as the proportional increasing or decreasing of the sizing of these components will accommodate a variety of product applications.

In particular, the SHA embodiment may feature combining several of the individual components from the previous described embodiments during the manufacturing process, while retaining the primary function and the beneficial features of the general dispenser system 10. Referring to FIG. 11, the piston 44 and spindle 146, 46 of both of the DHA and SHA embodiments are replaced by a single component referred to as a threaded piston 244. Similarly, the piston collar 148, 48 and the collar cap 142, 42 of the DHA model and of the basic SHA model have been replaced by a single component referred to as the threaded collar cap 242.

Continuing to view FIG. 11, although both threaded collar cap 242 and actuator housing 222 may be considered geometrically modified relative to the DHA and SHA embodiments previously described, there are many similarities between embodiments. The threaded collar cap 242 and the actuator housing 222 of FIG. 11 still feature the alternating grooved surfaces of their respective circular outer walls to facilitate a non-slipping grip by the user. Thus, this portion of the pressurizing mechanism is similar to the like features of the previously described embodiments. Further, the threaded collar cap 242 may retain the internal threading required to threadably connect with the standard container 70 housing the desired product.

FIG. 11 also illustrates that in some embodiments the actuator housing 222 may feature only an outer circular wall 221 and an inner circular wall 223. The space defined within the inner circular wall 223 accepts the spring valve retainer 32 as it does in the previously described DHA and SHA embodiments, which itself accepts the valve stem seal 30 (comparable to the other embodiments shown in FIGS. 7 and 9). The threaded piston 244 travels up the internal threading of the lower inner circular wall 245 of the threaded collar cap 242. The lower inner circular wall 245 of the threaded collar cap 242 acts in like manner with respect to the threaded collar cap 48, 148 of the previously described SHA and DHA embodiments, respectively, extending beneath the outer circular wall 241. Further, the threaded collar cap 242 features an upper inner circular wall 243, similar to the upper inner circular wall 43 shown in FIG. 9 as part of a SHA embodiment, that seats within the annular space defined by the annular space formed between the outer circular wall 221 and the inner circular wall 223 of the actuator housing 222. Finally, the geometry of the cylindrical housing 250 of the second SHA embodiment as shown in FIG. 11 is different from the cylindrical housing 50 of both the SHA and the DHA embodiments. Instead of comprising windows 52 with which to engage the lugs 49 of the threaded collar 48 of the previously described SHA embodiment, it features an essentially smooth outer circular wall 251 with a retaining lip 259 encircling its upper end that provides a registration means by which to attach to the threaded collar cap 242.

In respect of several components of the SHA embodiment shown in FIG. 11, the dispenser system 10 may be considered to be more simple both in operation and in manufacture. Further, other embodiments of a dispenser system may provide a less complex mechanical relation and function of parts and less complex manufacture with respect to those embodiments previously described. One example of such a dispenser system is a SHA embodiment shown in FIGS. 15 and 16. Accordingly, and consistent with like features of the previously described embodiments, the dispenser system has a threaded piston 344 having threads, and in some preferred embodiments having only a portion of its length threaded as shown, engaging threads of an inner wall of a collar cap 342. The threaded piston 344, in some preferred embodiments, has a shoulder 346. The collar cap 342 further provides a depending cylinder housing portion 350. The cylinder housing portion 350 is part of and integral with the collar cap 342, reducing the number of parts of the dispenser system. The collar cap further provides a shoulder 348 corresponding to shoulder 346, shoulder 346 resting against shoulder 348 when the piston 344 is fully extended by rotation of actuator housing 322.

Figure 15:
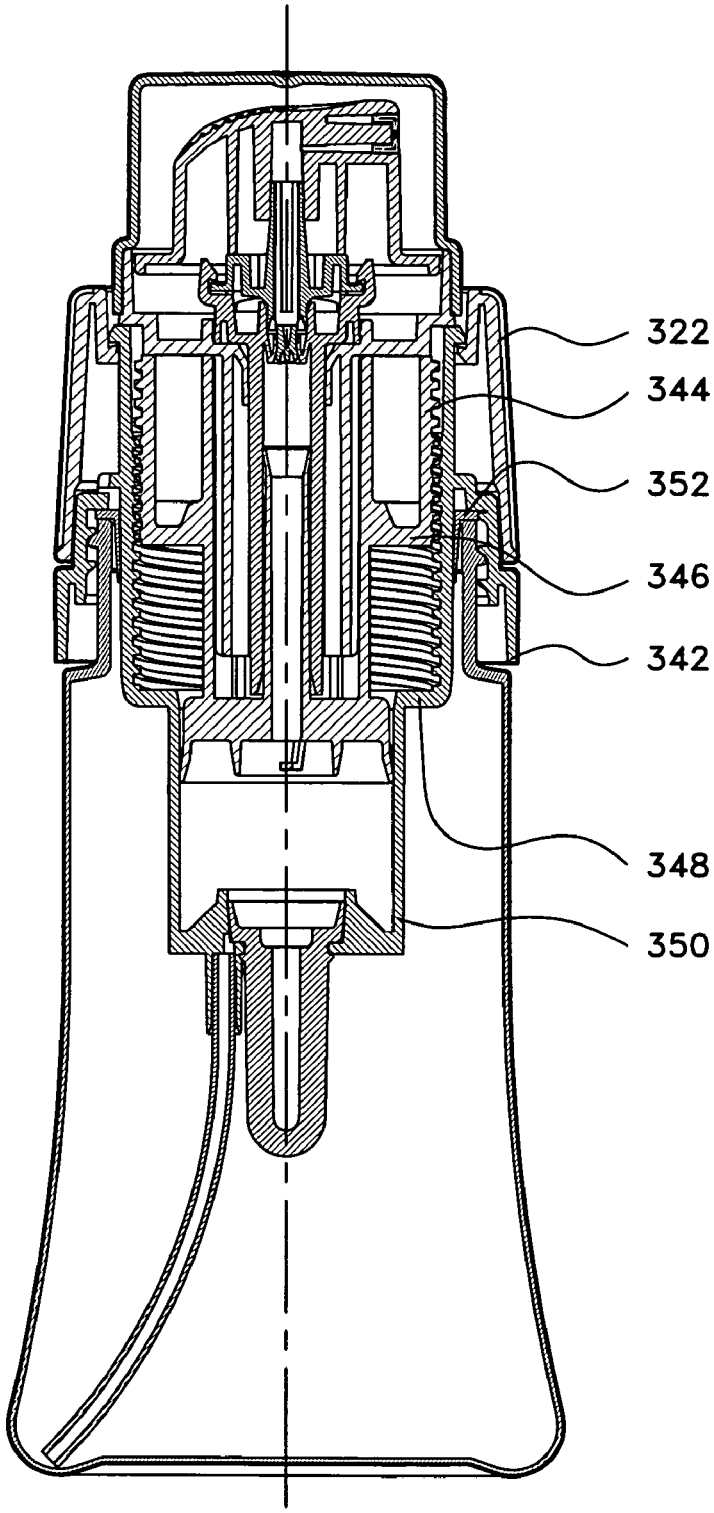
FIG. 15 is a sectional side view showing an embodiment of the present invention with the piston in the down position.
Figure 16:
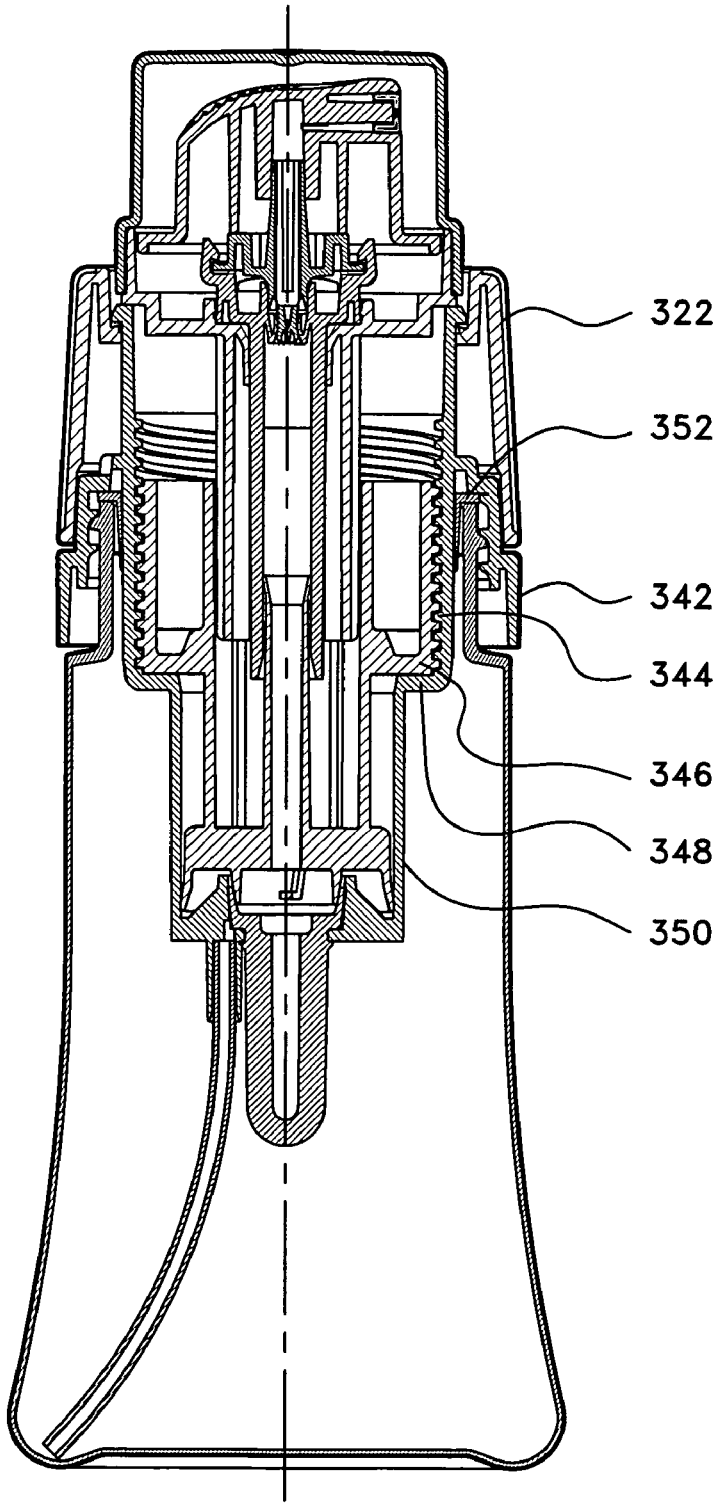
FIG. 16 is a sectional side view showing the embodiment of FIG. 15 with the piston in the up position.

The collar cap 342 may be referred to, in some embodiments, as a collar cap cylinder, serving as a cylinder housing consistent with the mechanical relationships and functions of the cylinder housings of previously described embodiments. The function and benefits of the dispenser of FIGS. 15 and 16 is consistent with the function and benefits of the other SHA embodiments as previously described. In summary, however, a rotation of the actuator housing 322, configured with piston 344, results in a rotation of the piston 344 by the mechanical relation shown and as previously described in other various embodiments. Rotation in one direction of the actuator housing creates an upward movement of the piston 344, drawing product into the cylinder housing portion 350. Rotation in a second direction of the actuator housing creates a downward movement of the piston 344, forcing the drawn product into the bladder and charging of the dispenser system.

Figure 14:
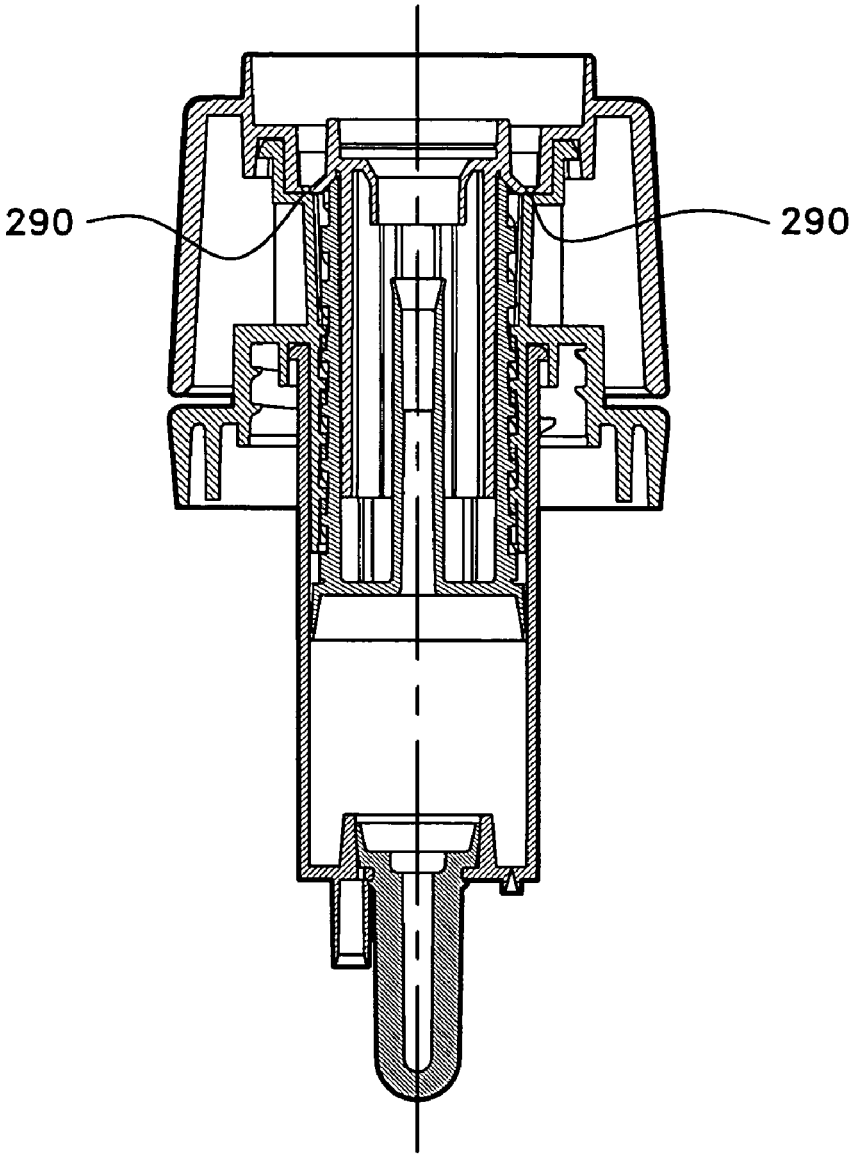
FIG. 14 is a sectional side view showing the embodiment of FIG. 11, as a sectional side view in 90 degree rotation from the cross-section of FIG. 12, particularly pointing out the vent holes, open to the atmosphere when the piston is fully extended, which allow the system to re-establish equilibrium.

Furthermore, a venting system is also disclosed. It should be first mentioned that the previously described embodiments may all include a venting system—and in some preferred embodiments the venting system is required because the dispensing system 10 is considered open, i.e., ambient air needs to be replaced when product is dispensed during the replenishing cycle of the dispensing sequence in order to offset the vacuum conditions created during the hydraulic priming. The venting system incorporated in the second SHA embodiments, as shown in FIG. 11, are the most efficient. Referring to FIGS. 12, 13 and 14, the venting system may include a pair of vent holes 290, located approximately 180° apart, and a pair of helix chambers, an upper helix chamber 292 and a lower helix chamber 294. The vent system may also comprise vents 243*a* in the upper inner circular wall 243, as best shown in FIG. 11. Functionally, when the vent holes 290 are open, i.e., when the threaded piston is at the apex of its downstroke, ambient air is allowed to enter the dispenser system 10 thus establishing an offset to the vacuum conditions created by the hydraulic priming and recreate an equilibrium condition within the system 10. The ambient air enters the upper helix chambers 292 and carries through the connection of the threaded collar cap 242 and the cylindrical housing 250, provided in some preferred embodiments as a window-to-latch configuration. Ambient air is also exchanged between the helix threads 296 of the interface between the cylindrical housing 250 and the lower circular inner wall 245 of the threaded collar cap 242 as the threads of the threaded piston 244 travels up and down the internal threads of the lower inner circular wall 245 of the threaded collar cap 242. This telescoping action of the helix threads 296 with the air exchange feature, facilitates the system's functioning attributes to aid in maintaining a pressure equilibrium within the container 70 relative to the ambient environment outside, and at the same time, allows air exchange throughout the dispensing stroke as well as the replenishing stroke.

Continuing to refer to FIGS. 12, 13 and 14, the two above discussed situations occur only through the opening of the vent holes 290, which in some embodiments occurs within every approximate 90° rotation during the telescoping action described above. In each cycle of this embodiment, there is only a full turn forward and backward that delivers approximately 15 seconds duration of spray with the vents holes 290 being open or closed throughout this cycle. Thus, the system 10 remains in a sealed "vents closed" position during the period in which the threaded piston 244 is fully retracted. For this reason, the system 10 can be assembled to the container 70 in a mode where the piston is fully extended and shipped to the user as a sealed container in this same configuration.

It should be further noted that some dispenser embodiments may provide a venting system as a multiple part venting system, incorporating gaskets in combination with holes, vents, or other like vent elements and in conjunction with the mechanical and telescoping action previously described, as may be shown in FIGS. 15 and 16 having gasket 352. Alternative embodiments may provide a one-piece design providing open and closed configurations primarily through the mechanical and telescoping action previously described, as provided in the embodiment of FIGS. 11-14.

As can be easily understood from the foregoing, the basic concepts of the present invention may be embodied in a variety of ways. It involves both method and process as well as apparatus and device. In this application, embodiments may be disclosed as part of the results shown to be achieved by the various plurality of apparatus and device described and as steps which are inherent to utilization. They are simply the natural result of utilizing the plurality of apparatus and device as intended and described. In addition, while a plurality of apparatus and device are disclosed, it should be understood that these not only accomplish certain methods and processes but also can be varied in a number of ways. Importantly, as to all of the foregoing, all of these facets should be understood to be encompassed by this disclosure.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure.

Further, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each element disclosed should be understood to encompass a disclosure of the action which that element facilitates. Regarding this last aspect, as but one example, the disclosure of "an actuator" should be understood to encompass disclosure of the act of "actuating"—whether explicitly discussed or not—and, conversely, were there effectively disclosure of the act of "actuating", such a disclosure should be understood to encompass disclosure of "an actuator" and even a "means for actuating". Such changes and alternative terms are to be understood to be explicitly included in the description.

Any acts of law, statutes, regulations, or rules mentioned in this application for patent, and any patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition and are hereby incorporated by reference. Finally, all references listed in the list of References To Be Incorporated By Reference or other information statement filed with the application are hereby appended and hereby incorporated by reference; however, as to each of the above, to the extent that such information or statements incorporated by reference might be considered inconsistent with the patenting of this/these invention(s) such statements are expressly not to be considered as made by the applicant(s).

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

What is claimed is:

1. A mechanically pressurized dispenser, comprising:

a rotationally actuated piston pressurization assembly configured with a rotatable spindle and piston assembly comprising a rotatable spindle and a rotatable piston, wherein rotation of the piston pressurization assembly corresponds to rotation and linear travel of both the spindle and the piston, and wherein the piston comprises at least one groove element and the spindle comprises a plurality of threads, said groove elements and threads defining a single helical configuration, with said rotation and linear travel of the spindle and the piston corresponding to the single helical configuration.

2. A mechanically pressurized dispenser as described in claim 1, wherein said spindle is connected to said piston.

3. A mechanically pressurized dispenser, comprising:

a rotationally actuated piston pressurization assembly configured with a rotatable spindle and piston assembly comprising a rotatable spindle and a rotatable piston, wherein rotation of the piston pressurization assembly corresponds to rotation and linear travel of both the spindle and the piston, and wherein the piston pressurization assembly comprises a first plurality of threads, said spindle comprises a second plurality of threads, and said piston, said spindle, and said first plurality of threads comprise a double helical configuration, with said rotation and linear travel of the spindle and piston corresponding to said the double helical configuration.

4. A mechanically pressurized dispenser as described in claim 1 or 3, further comprising at least one helical vent.

5. A mechanically pressurized dispenser, comprising:

a rotationally actuated piston pressurization assembly configured with a rotatable spindle and piston assembly comprising a rotatable spindle and a rotatable piston, wherein rotation of the piston pressurization assembly corresponds to rotation and linear travel of both the spindle and the piston, and further comprising at least one helical vent wherein said at least one helical vent comprises a first helix chamber and a second helix chamber.

6. A mechanically pressurized dispenser as described in claim 4 or 5, further comprising a container, wherein said at least one helical vent provides pressure equilibrium of said container.

7. A mechanically pressurized dispenser as described in claim 4, 5 or 6, wherein said at least one helical vent provides pressure equilibrium corresponding to linear travel of said piston.

8. A mechanically pressurized dispenser as described in claim 4, 5 or 6, wherein said at least one helical vent provides pressure equilibrium corresponding to a rotation of said spindle.

9. A mechanically pressurized dispenser comprising:

an actuator for triggering a dispensing of a product;

a collar cap assembly comprising a collar cap for attachment to a container holding the product, a piston housing coupled in fluid communication with the container and capable of receiving a rotatable piston in combination with a rotatable spindle, and an expandable reservoir coupled in fluid communication with the piston housing; and a rotatable actuator housing configured with the collar cap assembly;

whereby rotation of the actuator housing in a first direction effects a rotation of the spindle and the piston and an upward linear travel of the spindle and the piston, the upward linear travel drawing product from the container into the piston housing;

and whereby rotation of the actuator housing in a second direction effects a rotation of the spindle and the piston and a downward linear travel of the spindle and the piston, creating a pressure differential in the housing and forcing the drawn product from the piston housing into the expandable reservoir.

* * * * *